United States Patent [19]

Teal

[11] Patent Number: 4,782,213

[45] Date of Patent: Nov. 1, 1988

[54] CEILING FAN ELECTRICALLY HEATING ENVIRONMENTAL AIR

[76] Inventor: Paul Teal, 237 Mariner Cir., Cotuit, Mass. 02635

[21] Appl. No.: 86,842

[22] Filed: Aug. 19, 1987

[51] Int. Cl.[4] ..... F04D 29/58; F24H 3/04; H05B 3/00

[52] U.S. Cl. ..... 219/372; 219/368; 416/5; 416/95

[58] Field of Search ..... 219/372, 368; 416/95, 416/5

[56] References Cited

U.S. PATENT DOCUMENTS

| | | | |
|---|---|---|---|
| 449,404 | 3/1891 | Dewey | 219/372 |
| 676,949 | 6/1901 | Hawkins | 219/372 |
| 1,479,494 | 1/1924 | Beck | 219/372 |
| 1,737,912 | 12/1929 | Bogard | 219/372 |
| 2,380,346 | 7/1945 | Thomlinson | 219/372 |
| 4,504,191 | 3/1985 | Brown | 219/372 X |

FOREIGN PATENT DOCUMENTS

| | | | |
|---|---|---|---|
| 42845 | 6/1910 | Austria | 416/95 |
| 8238 | of 1901 | United Kingdom | 219/372 |
| 436101 | 10/1935 | United Kingdom | 416/95 |
| 1208928 | 10/1970 | United Kingdom | 219/372 |

*Primary Examiner*—Anthony Bartis
*Attorney, Agent, or Firm*—Richard P. Crowley

[57] ABSTRACT

A fan, such as a ceiling fan, for heating and circulating air in an enviroment includes a plurality of fan blades rotatable by an electric motor. The blades are each provided with an open interior space defining an air flow passage transversely through the thickness of the blade in which is mounted an electric resistance heating element. Louvers having a plurality vanes are provided on the opposite sides of each fan blade over the open interior space thereof for deflecting air, upon rotation of the fan blade, through the open interior space over the heating element therein and to direct the heated air to the enviroment. The vanes of the louvers on the opposite sides of the blade are oppositely angled. Operation of the heating fan may be controlled by a thermostat responsive to the temperature of the enviroment.

12 Claims, 1 Drawing Sheet

CEILING FAN ELECTRICALLY HEATING ENVIRONMENTAL AIR

BACKGROUND OF THE INVENTION

Typically, electric fans, such as of the portable or ceiling fan variety, have been employed to circulate air in an environment through the movement or rotation of the fan blades by an electrical motor so as to permit the movement of the air by the rotation of the angle fan blades of the fan.

U.S. Pat. No. 1,737,912 discloses a rotary heating device which combines as a single unit a fan, such as a portable fan, and electrical heating elements enclosed within and arranged to heat the blades of the fan. The employment of heating elements on both sides of the fan blades permits heat to be transferred to the air coming into contact with the surfaces of the blades and the heated air to be moved upon rotation of the fan blades. The electrical heating elements described are reported to be effective to heat a room in a minimum amount of time through the heating and subsequent movement of the heated air from the fan blades through the operation of the fan. The heating elements employed are electric heating elements and are mounted in chambers in the fan blade with layers of insulating, but heat conductive, material on both sides thereof. Electrical energy is supplied to the electric-operated heating elements through the electric motor which operates the fan blades. It is an essential feature of the electrically heated fan disclosed that the heating elements be enclosed and sealed within the blades so that the air cannot get to or blow on the elements and thus impair the efficiency of the heating device.

It is desirable to provide for a new and improved electric heating fan and a system of heating an environment employing the fan and a method of heating air within the environment.

SUMMARY OF THE INVENTION

The invention relates to an electric heating fan and to a system of heating an environment employing the electric heating fan and to a method of heating air within an environment. In particular, the invention relates to an electrical heating fan and method wherein air is deflected or forced by the rotation of fan blades through and over a heating element within an open interior of one or more fan blades and heated air circulated by the fan blades into the environment.

The invention concerns a heating fan, such as, but not limited to, a ceiling fan or a portable fan, wherein air, circulated by movement of the fan blades, is heated by a heating element in a cut out or open interior space of the fan blades which includes a heating element therein so that air being deflected through the open or cut out interior of the fan blade, by rotation of the fan blade, is forced through and passed over the electrical heating elements, and the heated air is circulated back into the environment. The air in the environment is forced over and through the heating elements in the fan blades through the employment of louver, deflector or baffle-type means secured on and/or over one or both sides of the open area of the fan blade so as first to direct the air from the environment by rotation of the fan blade into the open interior space over the heating element, and thereafter, to deflect or direct the heated air back into the environment.

Typically, in one embodiment, the louver or baffle elements employed should comprise a plurality of spaced apart vanes with the edges so directed so as to provide for deflection and direction of the air in the desired direction. For example, in a heating ceiling fan, the louvers or baffles may be positioned either in the top or bottom, preferably both, of the fan blades, across the open spaced interior or cut out portion therein, so as to permit air to be forced from the top of the fan blades, through and over the heating elements and to be directed out of the bottom of the fan blades downwardly in the room. Of course, if desired, the louver or baffle means may be directed in the same or different direction, either in the top or the bottom, preferably the deflector or baffle means contain a plurality of parallel, spaced apart thin blades which are angled as to force the air downwardly through the open space in the fan blade and then outwardly and downwardly. In the use of the heating fan, for example, the blade edges on the top of the ceiling fan generally are exposed contrary to the movement of the fan blades to gather and force deflected air downwardly, and typically, may vary in angle from 30° to 60° from the plane of the fan blade. If desired, the deflector or baffle means may comprise, for example, a screen-type air deflecting grid which is placed over the open space on either one or both sides of the heating element so that upon rotation or movement of the fan blades and the angle of the fan blades, air is driven through the screen-type element, over the heating element and out the opposite side into the environment.

The invention also comprises a heating system employing the heating fan wherein the heating fan is employed in an environment, such as a closed room, to provide heated air for the room and wherein the heating fan is in electrical communication with a thermostat in the room, so that the heating elements in the fan are operated in response to the amount of heat required or the temperature in the environment thus providing sufficient circulated, heated air for a closed environment. The heating fan system, as described, typically there is a source of electrical power, such as ordinary house current, a thermostat means located in the environment, such as a closed room, and the heating fan itself which may comprise an electric heating fan motor with a shaft and with generally a plurality of fan blades secured to the shaft or directly to the shaft for rotation of the fan blades by the fan motor and heating elements disposed in one or more of the cut out or open interior area of the fan blades; a louver or baffle means over the open interior area, at least on one side, in order to direct the flow of air into or out of the open heating element area of the fan blades; an electrical communication means, such as wires, connecting the source of electric power, the thermostat means and the fan motor; and electrical heating elements in the fan blades. The electrical heating elements in the open interior of the fan blades may be connected in similar manner as the heating elements placed on the surface of the fan blades as set forth in U.S. Pat. No. 1,737,912.

The heating fan system and method of the invention thus provide a unique and efficient means of providing for circulating and heating air in an environment.

The invention will be described for the purposes of illustration only in connection with a particular embodiment of a heating ceiling fan and system; however, it is recognized that various changes, additions and improvements may be made by those persons skilled in the art to the specific embodiment, all falling within spirit and scope of the invention.

DESCRIPTION OF THE EMBODIMENTS

Figure 1:
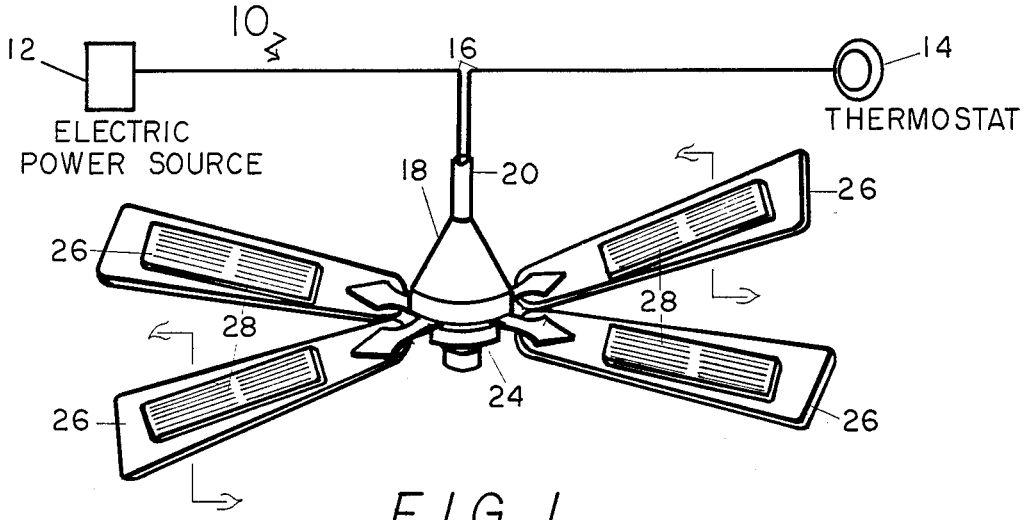
FIG. 1 is a schematic illustration of a heating system in a room showing a perspective view of the heating ceiling fan of the invention.

FIG. 1 shows a heating fan system 10 employing a source of electric power 12 and a thermostat 14 in an enclosed space, such as a room, and electrical wires 16 from the source 10 the thermostat to the ceiling fan, the fan comprising a vertical shaft 20 leading to a top cover 18 enclosing a rotating lower hub 22 secured to the end of the vertical shaft from the electric motor 40, the hub 24 being secured to the motor shaft for rotation therewith, while secured to the hub are four angled fan blades 26 having open-vaned louvers 28 on the top surface thereof.

Figure 2:
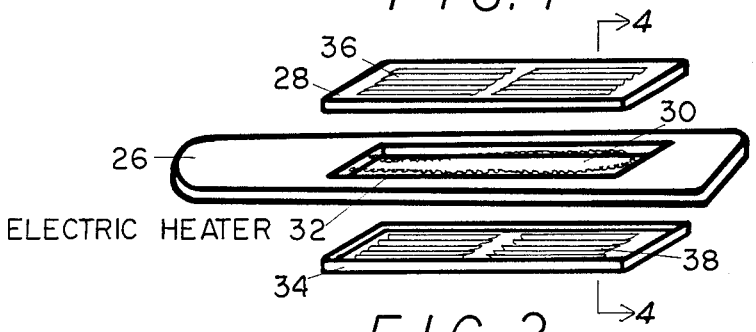
FIG. 2 is a schematic, exploded, perspective view of one of the fan blades of the invention of FIG. 1.
Figure 3:
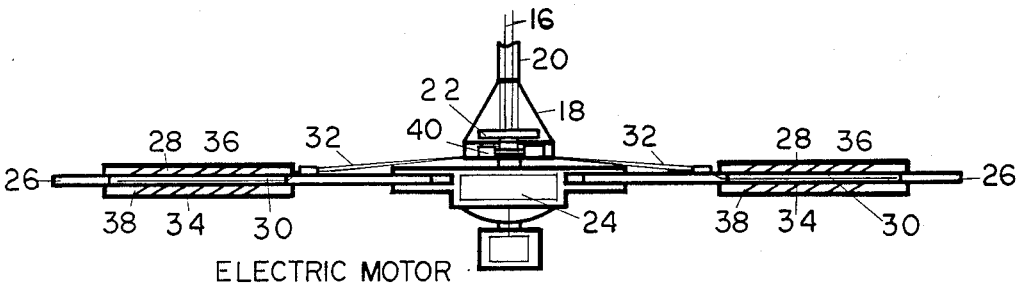
FIG. 3 is a sectional view of the heating fan of FIG. 1 taken along 3—3 thereof.
Figure 4:
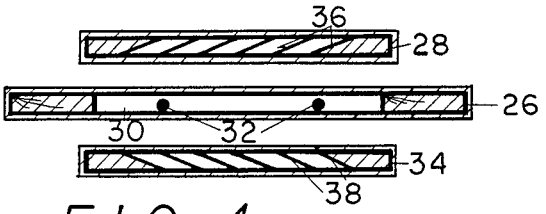
FIG. 4 is a sectional exploded view along line 4—4 of FIG. 1.

As shown, the ceiling fan and fan blades, as shown more particularly in FIGS. 2–4, wherein one of the fan blades 26 has a generally rectangular, cut out open space 30 in the fan blade which contains heating elements 32 disposed throughout most of the length of the open space 30 and open-vaned louver 28 secured to the top and over the open space 30, and a open-vaned louver 34 secured to the bottom of surface of the fan blade 26 and over the open space 30. Both the open louvers 28 and 34, having a plurality of spaced apart, parallel small edge vanes 36 and 38, the edge vanes 38 angled and disposed so as to be contrary to, i.e. to face, the rotational movement of the fan blade and to force air through the angled vanes 36 downwardly over the heating elements 32 and the open space 30, then through lower louver 34 containing the angled vanes 38 to force the heated air in the opposite direction. Of course, the angled vanes 36 and 38 may be placed in either direction or even have various directions within the louvers so as to direct the air to be heated or the heated air in any direction. The angle of the vanes may vary but generally may be 30° to 60°, e.g. 45°, from the plane of the vane.

In the heating ceiling fan and system as illustrated 10, when the environment, such as a room, has reached the desired temperature to which the thermostat 14 has been set, electricity is no longer provided to the electrical heating elements 32, while the fan blades optionally may continue to rotate to provide continued circulation of the heated air or the electricity to the fan motor may be shut off when the heating elements are shut off or shut off by a separate switch. Preferably, on the room reaching the appropriate temperature not only the heating elements, but also the motor is electrically disconnected until the temperature drops below the desired temperature at which time the fan motor and heating elements are again electrically activated from the the power source 12 and heating commences until the appropriate room temperature is reached again as set by the thermostat.

The heating ceiling fan, as illustrated, has shown the heating elements 32 disposed in cut out spaces 30 located in each of the fan blades. However, it is recognized, of course, that the heating elements may be placed in opposing pairs, and not all fan blades may need or require heating elements. Further, in the heating ceiling fan, as illustrated, the air is forced from the top of the ceiling fan downwardly through the open space 30 and heating elements 32 and downwardly into the room, which is the preferred mode of operation.

The heating elements 32 are secured to an electrical connecting means and contacting rings in the hub 24, the electrical heating elements at the one end are in electrical contact with rings through a spring-type or tensioned contact which brushes in contact with a central copper ring which is in electrical contact through the hub with the electrical power source. Typically, the electrical heating elements 32 are much higher resistance heating wires or Calrod-type elements, which may be disposed in various manners in the open space 30, and suitably insulated at the one end passed through the fan blade which is secured at one end to the hub in the electrical communication with the power source 12.

The heating fan system and method provide for the forced air circulation over a heating element in a fan blade and the forced circulation of heated air into an environment in a unique and efficient manner.

What is claimed is:

1. A heating fan for the circulation of heated air in an environment, which fan comprises:

(a) a fan housing;

(b) an electrical motor means in the housing, the motor means having a shaft, the motor means to provide for rotation of the shaft;

(c) a plurality of fan blades secured for rotation with the shaft, at least one of the fan blades characterized by an open interior space defining an air flow passage transversely through the thickness of the blade;

(d) an electrical heating element within said open interior space of at least one fan blade; and (e) air deflecting means on at least one side of the open interior space of each of said at least one fan blade to direct air, on rotation of the said at least one fan blade, through said open interior space thereof over the electrical heating element and to direct heated air into the environment.

2. The fan of claim 1 which includes connection means for electrically connecting an electrical power source to the fan motor and to the electrical heating element.

3. The fan of the claim 1 wherein the air deflecting means comprises at least one louver, said at least one louver having a plurality of generally parallel, spaced apart, angled, small vanes.

4. The fan of claim 3 wherein said fan blades are horizontally disposed and said at least one louver includes a top louver placed over one side of said open interior space, and a bottom louver placed over the opposite side of said open interior space, the top louver having angled vanes positioned to direct air downwardly into the said open interior space on rotation of at least one said fan blade.

5. The fan of claim 1 wherein the fan comprises a ceiling fan, the fan is adapted to be secured to the ceiling of a room with said fan blades horizontally disposed, and wherein the air deflecting means directs air from the top of the fan downwardly through the said open interior space of the at least one fan blade and downwardly into the room.

6. A heating fan, which comprises:

(a) a fan housing;

(b) an electrical motor means in the housing, the motor means having shaft, the motor means to provide for rotation of the shaft;

(c) a plurality of fan blades secured for rotation with the shaft, at least one of the fan blades characterized by an open interior space defining an air flow passage transversely through the thickness of the blade;

(d) an electrical heating element within said open interior space of at least one fan blade;

(e) air deflecting means on at least one side of the open interior space of each of said at least one fan blade to direct air, on rotation of the said at least one fan blade, through said open interior space thereof over the electrical heating element and to direct heated air into the environment;

(f) a thermostat means responsive to the temperature of an enclosed environment;

(g) a power source for the motor and the fan heating element; and (h) an electrical communicating means providing an electrical connection between the power source, the fan motor, the heating elements and the thermostat means whereby the enclosed environment is maintained at a desired temperature through setting a temperature on the thermostat means, which thermostat means controls the electrical heating element in at least one fan blade.

7. The fan of claim 1 wherein each of the plurality of fan blades includes an open interior space, an electrical heating element in the space and an air deflecting means.

8. A heating fan for the circulation of heated air in an environment, which heating fan comprises:

(a) a fan housing;

(b) an electrical motor means in the housing having a shaft, the motor means to provide rotation of the shaft;

(c) a plurality of fan blades secured for rotation with the shaft, at least one of the fan blades characterized by a substantially open interior cut out portion defining an air flow passage transversely through the thickness of the blade;

(d) an electrical heating element disposed within the open, interior cut out portion of the fan blade in the path of the air flow therethrough; and (e) an air deflecting louver means on at least one side of the open interior cut out portion of each of said at least one fan blade, the louver means comprising a plurality of generally parallel, spaced apart, small, angled vanes, the louver means being arranged to direct air, on rotation of the fan blades, through said open interior cut out portion of at least one fan blade and into a heating relationship with the heating elements in the open interior and to direct heated air from the open interior into the environment.

9. The method of circulating heated air into an environment, which method comprises:

(a) providing a rotatable fan blade having an open interior space defining a flow passage through the thickness of the blade and an electrical heating element disposed in said air flow passage; and (b) providing air deflection means on at least one side of the blade over the interior space thereof for deflecting air, upon rotation of the fan blade, through the open interior space containing the electrical heating element, rotating the blade to cause the air deflection means to direct air from the environment to be directed through said open interior space over the electric heating element to be heated for discharge into the environment.

10. The method of claim 9 which includes monitoring the temperature of the environment and providing electrical power to the heating element in the open interior of the fan blades in response to the temperature of the environment falling below a predetermined level.

11. The method of claim 9 wherein the provision of said deflection means includes disposing small, angled vanes on said blade in the direction of rotation of the fan blade so as to force and deflect air on rotation of the fan blade through the open interior space of the fan blade into a heating relationship with the electrical heating element in the fan blade.

12. The method of claim 9 which includes causing said deflection means to deflect air, on rotation of the fan blade, in one direction into the open interior space and into a heating relationship with the heating element and to deflect the heated air, on rotation of the fan blade, out of the open interior space and into the environment.

* * * * *